US006810759B2

(12) United States Patent
Tachibana

(10) Patent No.: US 6,810,759 B2
(45) Date of Patent: Nov. 2, 2004

(54) ENGINE STARTER

(75) Inventor: Fusao Tachibana, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/851,889

(22) Filed: May 9, 2001

(65) Prior Publication Data

US 2001/0039845 A1 Nov. 15, 2001

(30) Foreign Application Priority Data

May 11, 2000 (JP) ..... 2000-137896

(51) Int. Cl.[7] ..... F02N 1/00
(52) U.S. Cl. ..... 74/6; 123/179.1; 123/185.1
(58) Field of Search ..... 74/6; 123/179.1, 123/179.24, 179.25, 185.1

(56) References Cited

U.S. PATENT DOCUMENTS 1,936,554 A * 11/1933 Lansing ..... 185/41 R
4,038,051 A * 7/1977 Ide ..... 137/204
4,424,989 A * 1/1984 Spencer et al. ..... 138/40
4,480,605 A * 11/1984 Bloemers ..... 123/185.3
4,491,754 A * 1/1985 Gotoh ..... 310/43
4,582,030 A * 4/1986 Reese ..... 123/185.3
4,676,205 A * 6/1987 Kaufman ..... 123/195 R
4,757,710 A * 7/1988 Haynes ..... 116/276
4,789,363 A * 12/1988 Wicklein ..... 440/2
4,808,871 A * 2/1989 Morishita et al. ..... 310/43
4,848,288 A * 7/1989 Murase et al. ..... 123/179.24
4,887,476 A * 12/1989 Yokoyama ..... 74/7 E
4,924,959 A * 5/1990 Handa et al. ..... 123/185.3
4,978,864 A * 12/1990 Ida et al. ..... 290/48
5,052,234 A * 10/1991 Sugiyama ..... 123/179.25
5,101,114 A * 3/1992 Isozumi et al. ..... 290/48
5,159,845 A * 11/1992 Wada et al. ..... 123/179.1
5,285,636 A * 2/1994 Mayo et al. ..... 60/39.094
5,386,881 A * 2/1995 Eshelman ..... 184/1.5
5,632,659 A * 5/1997 Martin et al. ..... 123/198 D
6,035,732 A * 3/2000 Ogishima et al. ..... 310/60 A
6,083,381 A * 7/2000 Connelly et al. ..... 137/172

FOREIGN PATENT DOCUMENTS

GB 2 274 251 * 7/1994

* cited by examiner

*Primary Examiner*—David A. Bucci
*Assistant Examiner*—Julie K. Smith
(74) *Attorney, Agent, or Firm*—Martin A. Farber

(57) ABSTRACT

An engine starter includes a recoil device, and a recoil cover for accommodating the recoil device therein also covers a flywheel operatively rotated with the recoil device, ring gears integrally fixed to the flywheel, and pinions which are components of a starter device and engage with the ring gears when the starter device is operated. The recoil cover is provided with a drain mechanism, including a boss formed integrally with the recoil cover, a drain pipe projected on the boss, and a drain cap plugged to the drain pipe and made of rubber so that it is manually detachable therefrom without using a tool. Thus a liquid such as muddy water which has entered from the recoil cover can be removed simply by pulling out the drain cap.

3 Claims, 5 Drawing Sheets

ENGINE STARTER

BACKGROUND OF THE INVENTION

The present invention relates to an engine starter suitable for an all-terrain vehicle (hereinafter referred to as ATV) in which the engine sometimes needs to be started by using a recoil device.

ATV known as an off-road vehicle is mainly used for driving over grassy, sandy, or hilly terrain, and road races on such rough terrain by using ATV are commonly held. While driving, the vehicle may go into a puddle or a muddy spot and be stuck therein, with the engine being stalled. ATV is normally provided with an engine starter for immediately starting the engine in such situation.

FIG. 4A is a front view of a known engine and FIG. 4B is a cross-sectional view taken along the line A—A in FIG. 4A. FIG. 5 is a cross-sectional side view of a portion where the engine starter 100 including a recoil device 101 and a starter device 102 is mounted.

The recoil device 101 is accommodated within a recoil cover 103. Within the recoil cover 103 are also encased a flywheel 105 attached to a distal end of a crankshaft 104, ring gears 106 integrally fixed to the flywheel 105, and pinions 102*a* which are parts of the starter device 102 and make engagement with the ring gears 106 when the starter device 102 is operated, as shown in FIG. 5. A recoil lever 107 is loosely fitted into a recoil guide 108 protruded on an upper part of the recoil cover 103, and a screwed drain plug 109 is provided at a lower part of the recoil cover 103 as shown in FIG. 4A.

When the recoil lever 107 is pulled in the direction of the arrow shown in FIG. 4A, recoil pulleys 111 are rotated through ropes 110 within the recoil device 101, whereupon the flywheel 105 are operatively rotated with the recoil pulleys 111, thereby rotating the crankshaft 104 and causing the engine to start. The ring gears 106 integrally attached to the flywheel 105 are also rotated with the flywheel 105.

When the vehicle is stuck in a muddy spot or a puddle and the engine stops, by pulling the recoil lever 107 for starting the engine as described above may allow a liquid such as muddy water to enter the recoil cover 103 through a gap G (see FIG. 4B) formed between the recoil guide 108 and the ropes 110. Such muddy water may be spattered around by the rotating ring gears 106 within the recoil cover 103, causing the pinions 102*a* of the starter device 102 to rust.

A solution to this problem would be to remove muddy water collected inside the recoil cover 103 immediately, followed by adequate rust-resisting treatment. However, with the conventional drain plug 109, removal of the muddy water entails opening and closing of the plug using a tool, and such operation is often shunned in view of the inconvenience.

Another solution to the problem would be to provide a recoil cover chamber for accommodating the recoil device therein and flywheel cover chamber for encasing the flywheel, the ring gears, and the pinions engaged therewith, and further a cooling fan in some cases, individually, such that a liquid-tight seal is formed between the two chambers. While such structure would be effective to prevent muddy water from entering the flywheel cover chamber, it is undesirable from a physical standpoint of the engine which should be small-sized and light-weighted.

SUMMARY OF THE INVENTION

An object of the present invention is to provide an engine starter which solves the problem of rusting of pinions in the starter device induced by a liquid such as muddy water which infiltrates into the cover, while satisfying the physical requirements of small size and light weight of the engine.

Another object of the invention is to provide an engine starter with which the presence of such a liquid within the recoil cover is readily discerned.

To achieve the above-described objects, an engine starter according to a first aspect of the invention includes a recoil device, a ring gear operatively rotated with the recoil device, a recoil cover for accommodating the recoil device and the ring gear therein, a starter device having pinions engaged with the ring gear, and a drain mechanism provided to the recoil cover which enables a liquid such as muddy water which has entered from the recoil cover to be discharged by one-touch operation. The drain mechanism enables any liquid which has entered from the recoil cover to be swiftly removed, whereby the problem of rusting of the pinions of the starter device is solved, while the physical requirements of small size and light weight of the engine also are satisfied.

Drain mechanism which lets a liquid drain by one-touch operation has a structure wherein the liquid within the recoil cover is readily discharged by removing a plug member or the like without using a tool. Thus the drain mechanism if the invention allows easy access to the interior of the recoil cover for removing muddy water and for easy maintenance.

In the engine starter according to a second aspect of the invention, the drain mechanism includes a transparent pipe member attached to the recoil cover, and a plug member fitted to the pipe member. Thereby, the drain mechanism not only permits the muddy water inside the recoil cover to be swiftly removed, but also makes the muddy water present inside the recoil cover readily discernible from outside.

In the engine starter according to a third aspect of the invention, the recoil cover includes a window for allowing the liquid therein to be visible from outside. The liquid such as muddy water which has entered from the recoil cover is therefore discernible from outside. Visual perception of liquid present inside the recoil cover is further facilitated by the provision of such window in addition to the drain mechanism as set forth in the foregoing.

In the engine starter according to a fourth aspect of the invention, the recoil cover includes a compressed air injection hole for introducing compressed air to forcibly discharge the liquid such as muddy water inside the recoil cover, and a lid member for closing the compressed air injection hole. Thereby, muddy water can be quickly and thoroughly removed by forcibly discharging same using the compressed air.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

An engine starter according to embodiments of the present invention will be hereinafter described with reference to the accompanying drawings.

Figure 1:
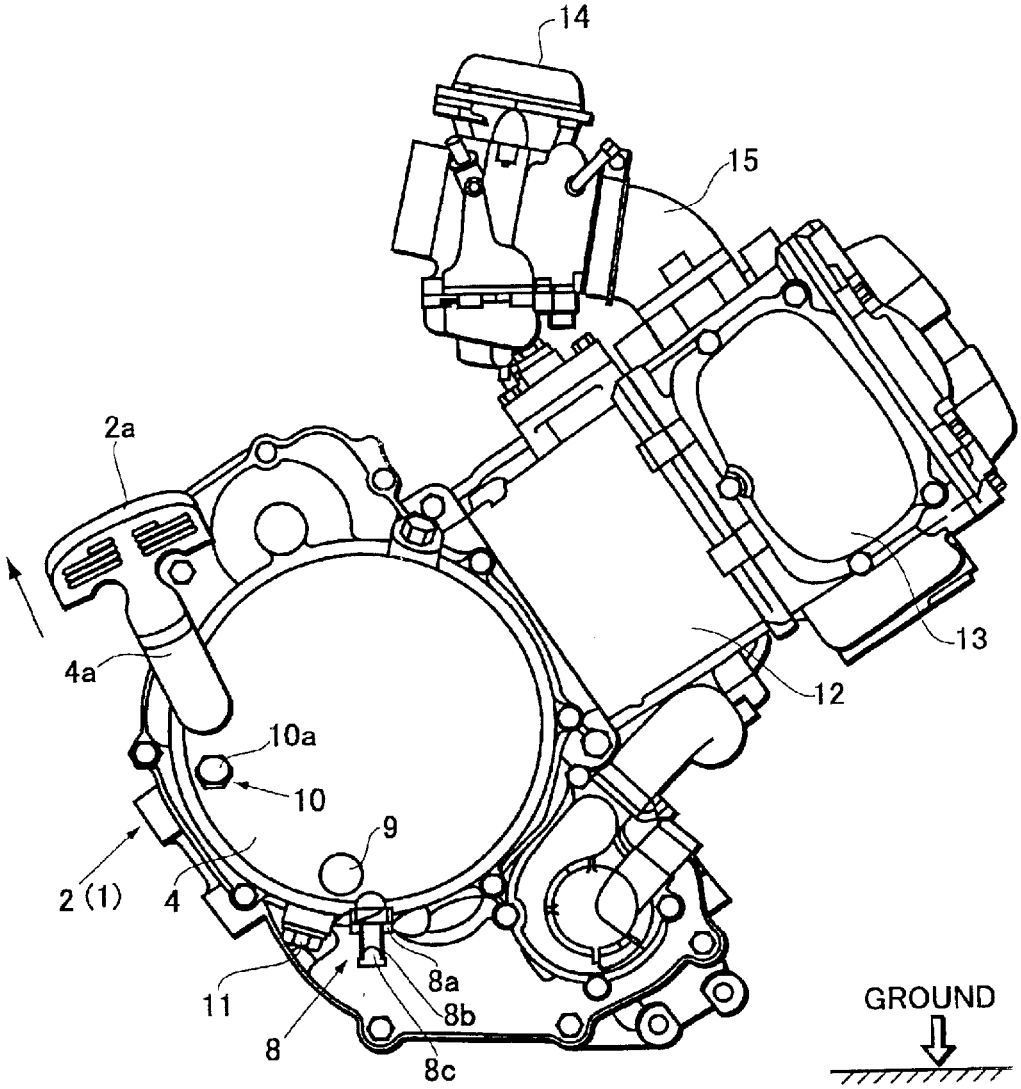
FIG. 1 is a front view showing an engine to which an engine starter according to a first embodiment of the invention is mounted.
Figure 2:
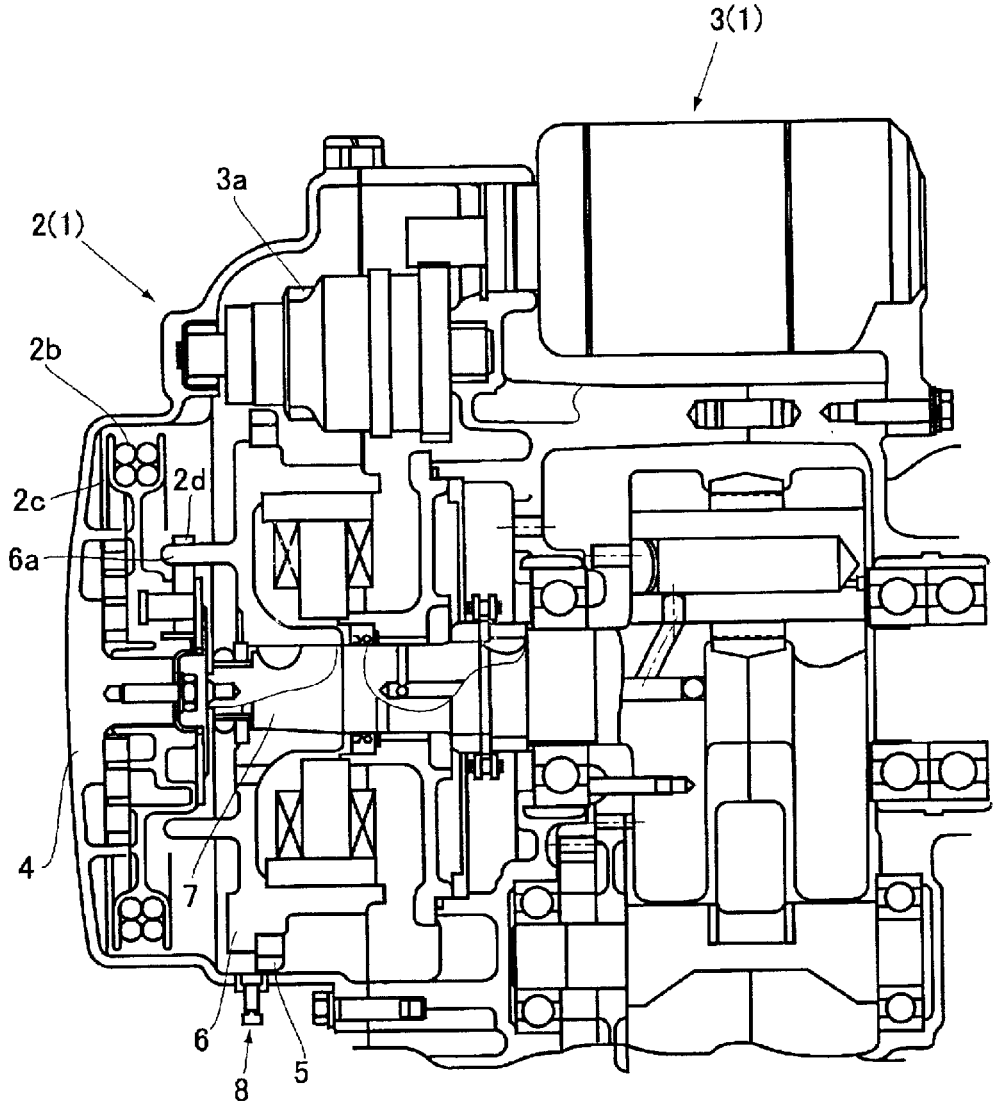
FIG. 2 is a cross-sectional side view showing a portion where the engine starter of FIG. 1 is mounted.

FIGS. 1 and 2 illustrate an engine starter 1 according to a first embodiment of the invention. The engine starter 1 is composed of a recoil device 2 and a starter device 3. A cup-shaped recoil cover 4 for accommodating the recoil device 2; therein also covers a flywheel 6 and ring gears 5 integrally formed therewith and operatively rotated with the recoil device 2 in engagement with pinions 3*a* of the starter device 3. The recoil device 2 includes a recoil lever 2*a* loosely received in a recoil guide 4*a* protruded on the recoil Mover 4, ropes 2*b* connected to the recoil lever 2*a*, and recoil pulleys 2*c* around which the ropes 2*b* are wound. The flywheel 6 mounted to a distal end of a crankshaft 7 are operatively rotatable with the recoil device 2, and the recoil cover 4 for housing the recoil device 2 therein covers these flywheels 6 and the ring gears 5 integrally fixed to each outer periphery of the flywheel 6, as well as the pinions 3*a*, which are parts of the starter device 3 and engage with the ring gears 5 when the starter device 3 is operated.

The recoil device 2 and the flywheel 6 are operatively connected as mentioned above such that the recoil pulleys 2*c* and the flywheel 6 rotate together. For that purpose, engagement pieces 2*d* are provided on the recoil pulleys 2*c* so as to be protruded when the ropes 2*b* are pulled, and the flywheels 6 have protruding pieces 6*a* on each side face thereof which make contact with the engagement pieces 2*d* at a plurality of locations, only one of which is shown in FIG. 2. When the recoil lever 2*a* is pulled in the direction of the arrow shown in FIG. 1, the recoil pulleys 2*c* are rotated through the pulled ropes 2*b* and the flywheel 6 operatively Associated therewith as described above rotate, too, thereby rotating the crankshaft 7, whereupon the engine is started. The ring gears 5, which are integrally fixed to the flywheel 6, also rotate with the flywheel 6. When the recoil lever 2*a* is returned to its initial position, the engagement pieces 2*d* are brought out of contact with the protruding pieces 6*a*, the recoil pulleys 2*c* being disconnected from the flywheel 6, whereby only the flywheel 6 goes on rotating with the crankshaft 7.

The recoil cover 4 is provided with a drain mechanism 8 at its lowermost end as shown in FIG. 1 for enabling a liquid such as muddy water which has entered from the recoil cover 4 to be discharged by one-touch operation. The recoil cover 4 further has a hole for providing a window 9 obliquely above the drain mechanism 8 so as to make the muddy water inside the recoil cover 4 visually perceivable. A compressed air injection hole 10 is further formed in the recoil cover 4 located obliquely above the window 9 at a position near a circumferential end of the recoil cover 4 for introducing compressed air into the recoil cover 4 to forcibly discharge the muddy water therefrom.

The drain mechanism 8 includes a boss 8*a* formed in one piece with the recoil cover 4, a drain pipe 8*b* press-fitted to the boss 8*a*, and a drain cap 8*c* plugged into the drain pipe 8*b* and made of rubber, for example, so that it can be detachable from the drain pipe 8*b* by one-touch operation without using any tool. Thus the muddy water which has entered from the recoil cover 4 can be removed simply by pulling the drain cap 8*c* out. By providing rust-resisting treatment, for example, by spraying lubricating oil after removing the muddy water, the pinions 3*a* can be prevented from being rusted.

The window 9 is formed by fitting a thin, transparent plate made of plastic in the hole provided in the recoil cover 4, so that the interior of the recoil cover 4 is visible through the window 9 to determine whether muddy water has entered therein.

The compressed air injection hole 10 is provided to introduce compressed air into the recoil cover 4. Injection of compressed air into the recoil cover 4 enables muddy water therein to be quickly and thoroughly removed. When not in use, the compressed air injection hole 10 is closed by a lid member 10*a*.

In FIG. 1, a reference numeral 11 denotes a conventional screwed drain plug which is opened and closed using a tool. Such drain plug 11 may be provided adjacent the drain mechanism 8 as shown in this illustrated embodiment.

The engine provided with the engine starter 1 is inclined to the ground when mounted on a vehicle body as shown in FIG. 1. Reference numerals 12, 13, 14, and 15 respectively represent a cylinder case, a cylinder head, a carburetor, and an intake pipe.

Next, an engine starter 20 according to a second embodiment of the invention will be described with reference to FIG. 3. Elements in FIG. 3 which are common to those shown in FIGS. 1 and 2 are given the same reference numerals and the description thereof will be omitted.

The engine starter 20 of this embodiment is different from that of the above-described first embodiment in that the recoil cover 4 is provided with a drain mechanism 21 having a different structure from that of the drain mechanism 8.

Figure 3:
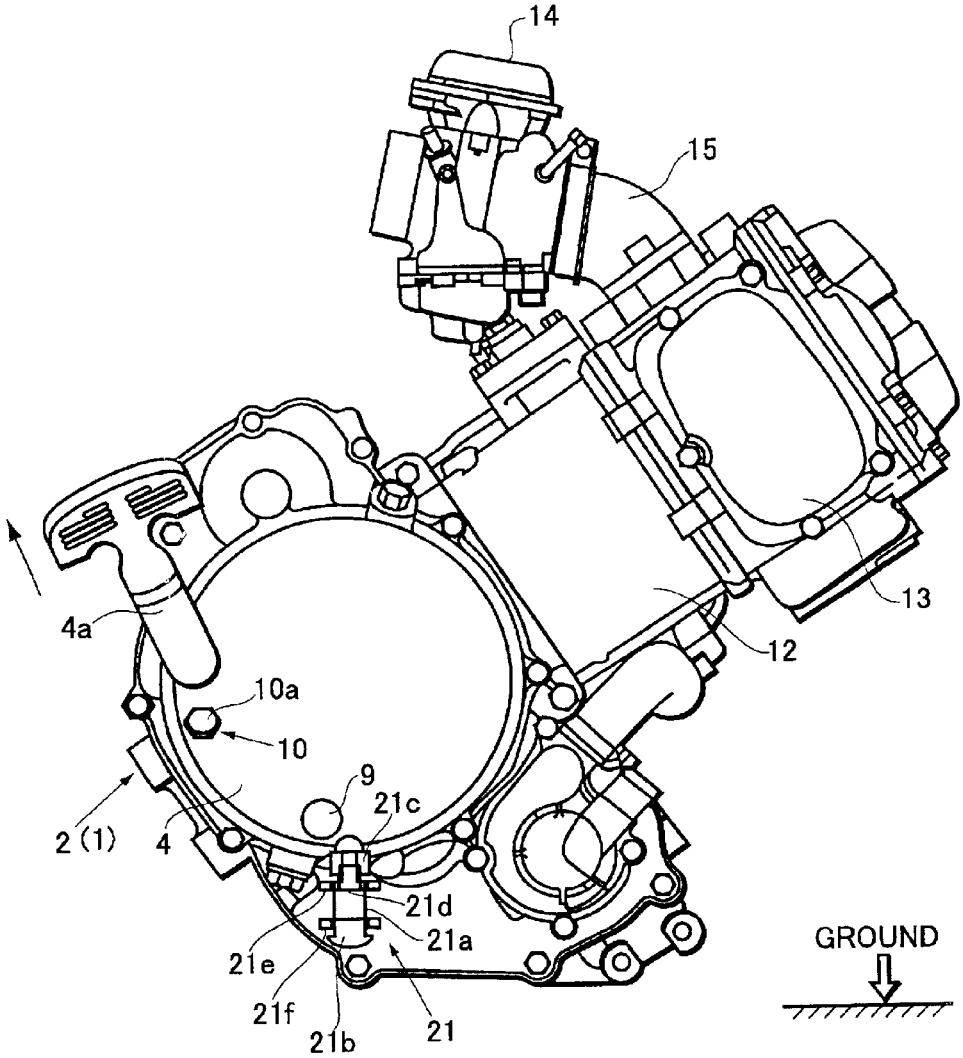
FIG. 3 is a front view showing an engine to which an engine starter according to a second embodiment of the invention is mounted.
Figure 4A:
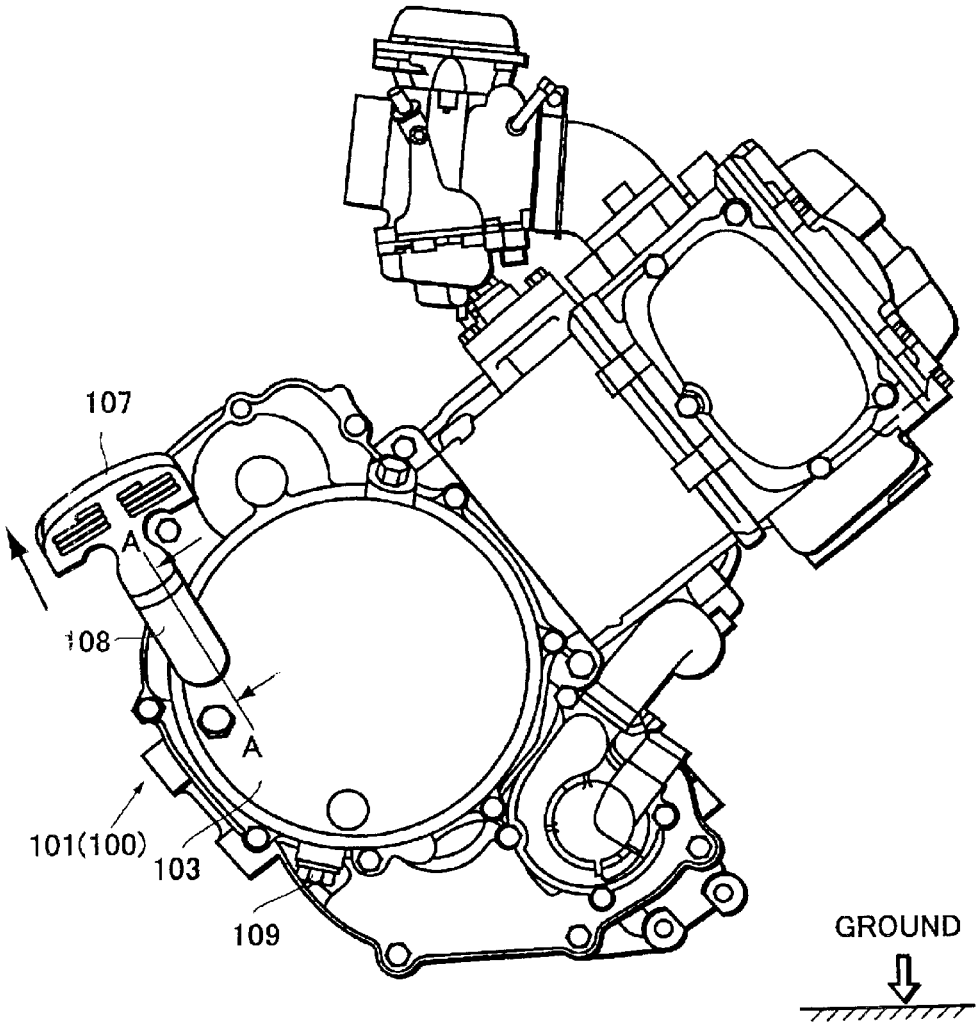
FIG.4 A PRIOR ART
FIG. 4A is a front view showing an engine to which a conventional engine starter is mounted.
Figure 4B:
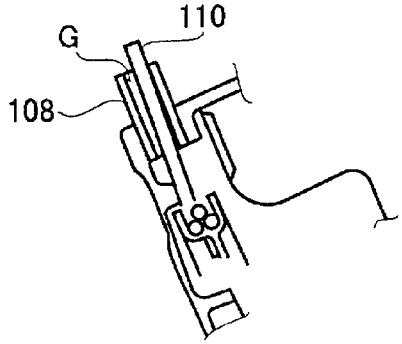
FIG.4 B PRIOR ART
FIG. 4B is a cross section taken along the line A—A in FIG. 4A.
Figure 5:
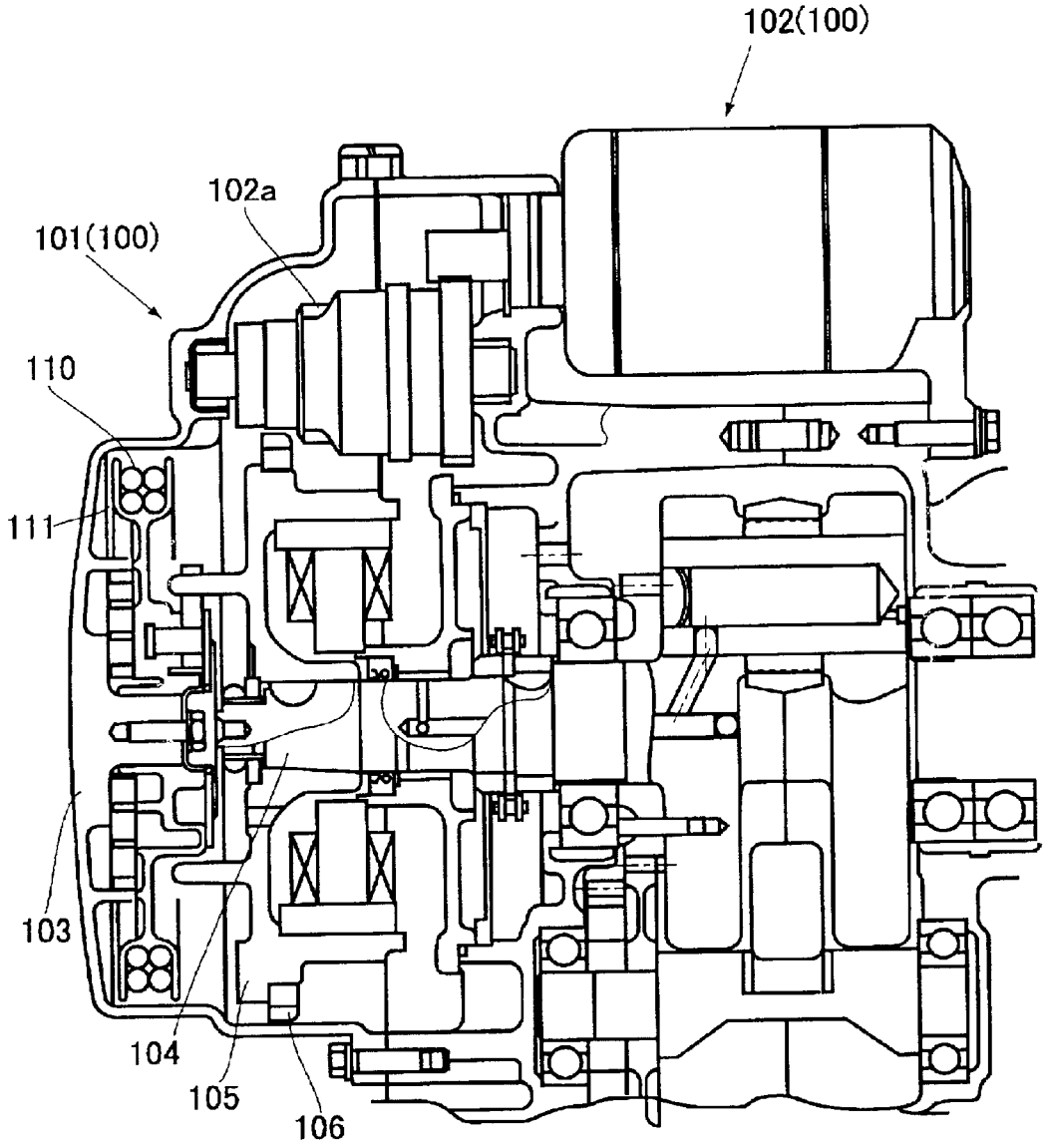
FIG.5 PRIOR ART
FIG. 5 is a cross-sectional side view showing a portion where the engine starter of FIG. 4A is mounted.

As shown in FIG. 3, the drain mechanism 21 includes a pipe member as a drain hose 21*a* made of a transparent material such as plastic, and a drain cap or a plug member 21*b* attached to the drain hose 21*a* and made of rubber so that it can be detachable from the drain hose 21*a* by one-touch operation without using a tool. In this embodiment, specifically, a boss 21*c* is formed integrally with the recoil cover 4, and an auxiliary pipe 21*d* is press-fitted to the boss 21*c*. The drain hose 21*a* is fixedly coupled, with a clip 21*e*, over the outer periphery of the auxiliary pipe 21*d* at one end thereof, and at the other end of the drain hose 21*a* is the drain cap 21*b* loosely fitted and securely fixed thereto with a clip 21*f*.

Thus the drain mechanism 21 enables muddy water inside the recoil cover 4 to be discharged simply by removing the clip 21*f* and pulling the drain cap 21*b* out. Also, even if the inside of the recoil cover 4 is hardly visible through the above-described window 9, the transparent drain hose 21*a* of the drain mechanism 21 makes the muddy water present inside the recoil cover 4 discernible from outside.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. An engine starter, comprising:

a recoil device;

a ring gear operatively rotated with said recoil device;

a recoil cover for accommodating said recoil device and said ring gear therein;

a starter device having pinions engaged with said ring gear only when said starter device is operated; and a drain mechanism provided on said recoil cover for allowing a liquid entering from said recoil cover to be discharged by one-touch operation; and wherein said drain mechanism includes a boss formed integrally with said recoil cover, and an auxiliary pipe is press-fit to said boss, wherein a drain hose is fixedly coupled via a clip over an outer periphery of said auxiliary pipe at one end thereof, and at the other end of said drain hose, a drain cap is loosely fitted and securely fixed thereto with a second clip.

2. An engine starter, comprising:

a recoil device;

a ring pear operatively rotated with said recoil device;

a recoil cover for accommodating said recoil device and said ring gear therein;

a starter device having pinions engaged with said ring gear only when said starter device is operated; and a drain mechanism provided on said recoil cover for allowing a liquid entering from said recoil cover to be discharged by one-touch operation; and wherein said recoil cover includes a window for allowing the liquid therein to be visible from outside; and the window of the recoil cover is positioned above the drain mechanism to provide for visibility of liquid in the recoil cover.

3. An engine starter, comprising:

a recoil device;

a ring gear operatively rotated with said recoil device;

a recoil cover for accommodating said recoil device and said ring gear therein;

a starter device having pinions engaged with said ring gear only when said starter device is operated; and a drain mechanism provided on said recoil cover for allowing a liquid entering from said recoil cover to be discharged by one-touch operation; and wherein said recoil cover includes a compressed air injection hole for introducing compressed air to forcibly discharge the liquid inside said recoil cover and a lid member for closing said compressed air injection hole; and the air injection hole is positioned above the drain mechanism to enable the compressed air to forcibly discharge the liquid from inside the recoil cover.

* * * * *